US008960801B2

(12) United States Patent
Hu

(10) Patent No.: US 8,960,801 B2
(45) Date of Patent: Feb. 24, 2015

(54) MULTI-FUNCTIONAL STRUCTURE FOR ARMCHAIR ARMREST PAD

(76) Inventor: Jung-Hua Hu, Tainan (TW)

( * ) Notice: Subject to any disclaimer, the term of this patent is extended or adjusted under 35 U.S.C. 154(b) by 236 days.

(21) Appl. No.: 13/573,407

(22) Filed: Sep. 14, 2012

(65) Prior Publication Data

US 2014/0077568 A1 Mar. 20, 2014

(51) Int. Cl.
*B60N 2/46* (2006.01)
*A47C 7/54* (2006.01)

(52) U.S. Cl.
USPC ..... 297/411.37; 297/411.38; 297/115

(58) Field of Classification Search
USPC ..... 297/115, 116, 411.37, 411.38
See application file for complete search history.

(56) References Cited

U.S. PATENT DOCUMENTS 5,927,811 A * 7/1999 Tseng ..... 297/353
6,074,012 A * 6/2000 Wu ..... 297/411.26
7,077,468 B2 * 7/2006 Maierholzner ..... 297/188.19
7,159,947 B1 * 1/2007 Lee ..... 297/411.37
7,387,341 B1 * 6/2008 Tsai ..... 297/411.35
7,559,609 B2 * 7/2009 Tsai ..... 297/411.35
7,641,284 B2 * 1/2010 Jones et al. ..... 297/411.2
7,766,408 B2 * 8/2010 Lota et al. ..... 296/37.1
7,837,269 B2 * 11/2010 Bock ..... 297/411.35
8,348,205 B2 * 1/2013 Yang ..... 248/118.1
8,474,914 B2 * 7/2013 Chen et al. ..... 297/411.37
8,678,503 B2 * 3/2014 Machael et al. ..... 297/411.37
2005/0184574 A1 * 8/2005 Tsai ..... 297/411.37
2005/0225148 A1 * 10/2005 Jones et al. ..... 297/411.35
2011/0248543 A1 * 10/2011 Hitchcock et al. ..... 297/411.36
2012/0025584 A1 * 2/2012 Chen et al. ..... 297/411.37
2012/0175934 A1 * 7/2012 Bock ..... 297/411.37
2014/0145490 A1 * 5/2014 Chen ..... 297/411.37

* cited by examiner

*Primary Examiner* — David R Dunn
*Assistant Examiner* — Timothy J Brindley
(74) *Attorney, Agent, or Firm* — Rosenberg, Klein & Lee

(57) ABSTRACT

A multi-functional structure for armchair armrest pad comprises an armrest frame connecting unit, a block slider, a movable fixing unit, a rotary positioning unit, a fixing unit, an inclined movable unit, a pressing unit, an armrest pad and a top board, wherein the unlocked position can easily get when pressing the pressing unit, thus the armrest pad can be adjusted to the front, back, left, right, and be rotated to the right and the left, and the locked position can easily get when letting go the pressing unit, thus the armrest pad can be fixed and remained the angle which is adjusted.

4 Claims, 7 Drawing Sheets

MULTI-FUNCTIONAL STRUCTURE FOR ARMCHAIR ARMREST PAD

BACKROUND OF THE INVENTION

1. Field of the Invention

A multi-functional structure for armchair armrest pad relates to an armrest pad, when operating a pressing unit, any unit in the armrest pad would be adjusted and locked or unlocked, so that the adjustment of any unit would be moved to the left or right, forward or backward or rotary at the same time or individually through the armrest pad.

2. Description of the Related Arts

The conventional structure of an armchair armrest is designed to move forward, backward, to the right and the left, however, the operating device for the armrests is always complicated. Complication usually brings a structure unsteadiness and inconvenience. Therefore, in order to improve the shortcoming mentioned above, there must be an improved structure designed to solve the problems.

SUMMARY OF THE PRESENT INVENTION

A multi-functional structure for armchair armrest pad comprises an armrest frame connecting unit, a block slider, a movable fixing unit, a rotary positioning unit, a fixing unit, an inclined movable unit, a pressing unit, an armrest pad and a top board, wherein a positioning groove set on one end of the inner wall of the armrest frame connecting unit, a window is set in the middle, and a button mounting slot is set near the window, a baffle bar is set in the button mounting slot; a block slider is set in the armrest frame connecting unit, a shrapnel is set in the positioning groove which corresponded with the armrest frame connecting unit, the teeth are set on the side of the button mounting slot which corresponded with the armrest frame connecting unit, a mounting slot is set in the middle of the block slider, baffle 1 is set on one side of the mounting slot which is near the shrapnel, and on the other side set a guiding unit inside and baffle 2 outside, a positioning groove is set on one inner side of the baffle 1; a movable fixing unit is set in the mounting slot of the block slider, a circular groove is set in the middle, a fitting hole on the movable fixing unit is set on the side out of the circular groove, teeth are set on the other side, a spring is set in the fitting hole, a ball is set on each end of the fitting hole; a rotary positioning unit is set in the circular groove of the movable fixing unit, a cylinder is at the expanded bottom, a positioning groove and wheel teeth are set correspondingly respectively with the fitting hole and the teeth of the movable fixing unit; a fixing unit is set on the block slider, wherein two fitting cylinders are set in the middle, a flexible unit is set on one side of the baffle 2, and upper teeth an down teeth are set on the other side, the upper teeth connects the wheel teeth of the rotary positioning unit and the down teeth connects the teeth of the movable fixing unit; an inclined movable unit is set on the fixing unit, whereon an inclined hole is set on the fitting cylinder corresponded with the fixing unit; a pressing unit is set in the button mounting slot of the armrest frame connecting unit, a fillister is set at the bottom corresponding with the baffle bar of the button mounting slot, on the two ends of the fillister, fitting teeth are set on one side of the teeth which corresponded with the block slider, a spring fitting hole is set on the other side; an armrest pad is covered on the armrest frame connecting unit, a fitting groove is set around the armrest frame connecting unit; a top board is set in the fitting groove.

BRIEF DESCRIPTION OF DRAWINGS

The drawings of preferred embodiments of this invention are described as follows.

DETAILED DESCRIPTION OF PREFERRED EMBODIMENTS

Figure 1:
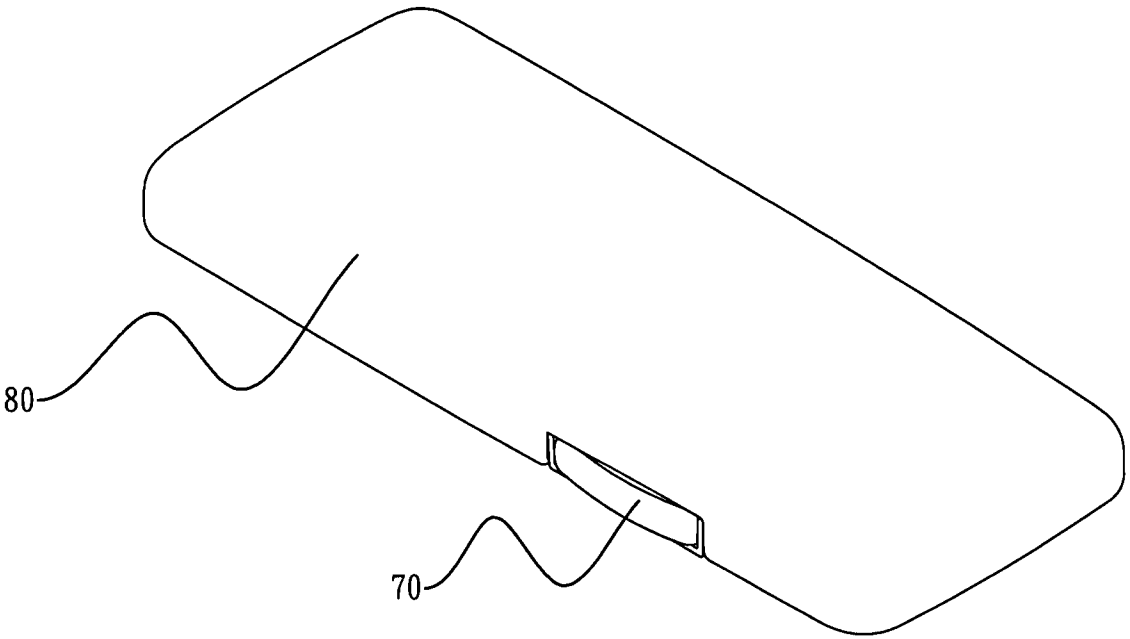
FIG. 1 is a schematic diagram of the present invention.
Figure 2:
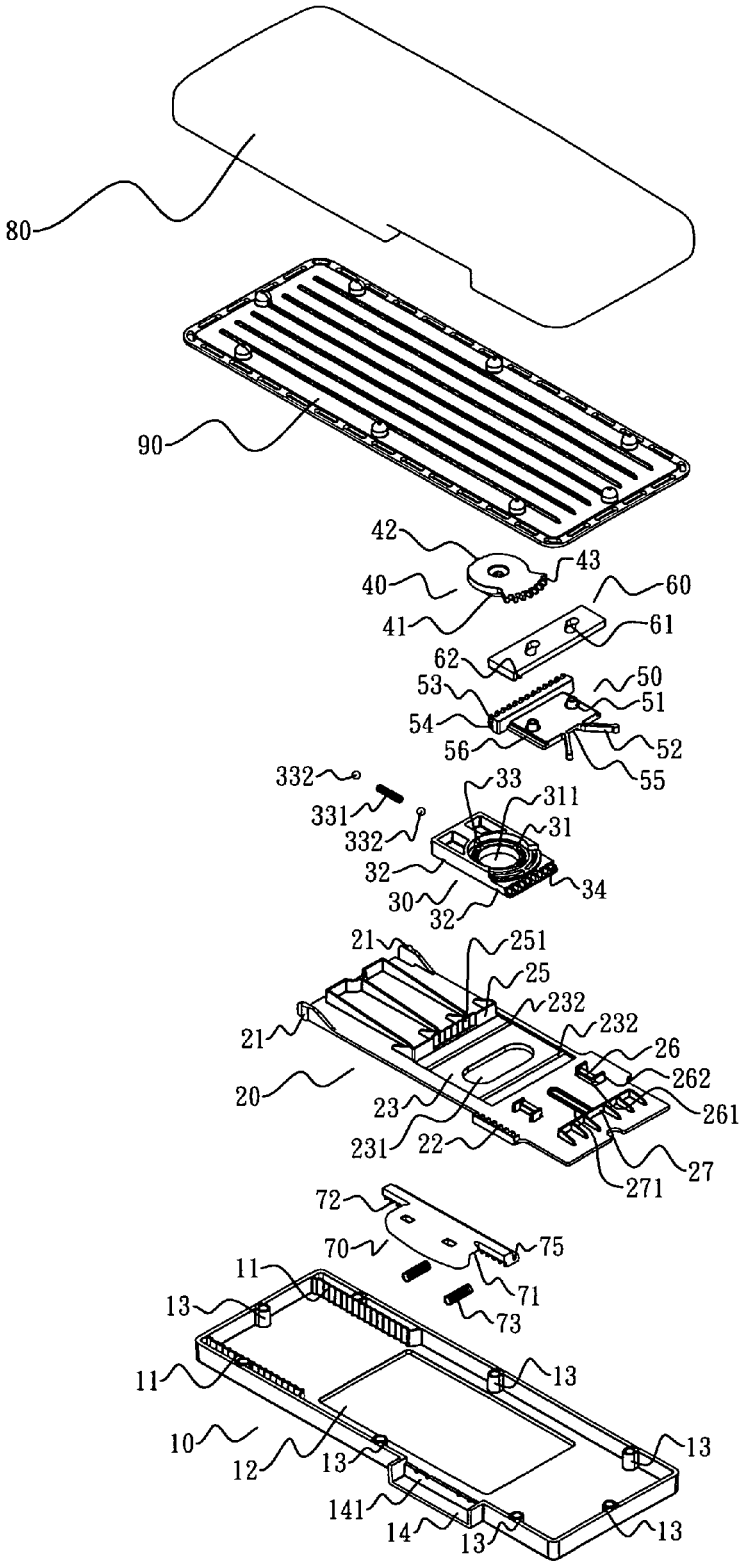
FIG. 2 is a first exploded view of the present invention.
Figure 3:
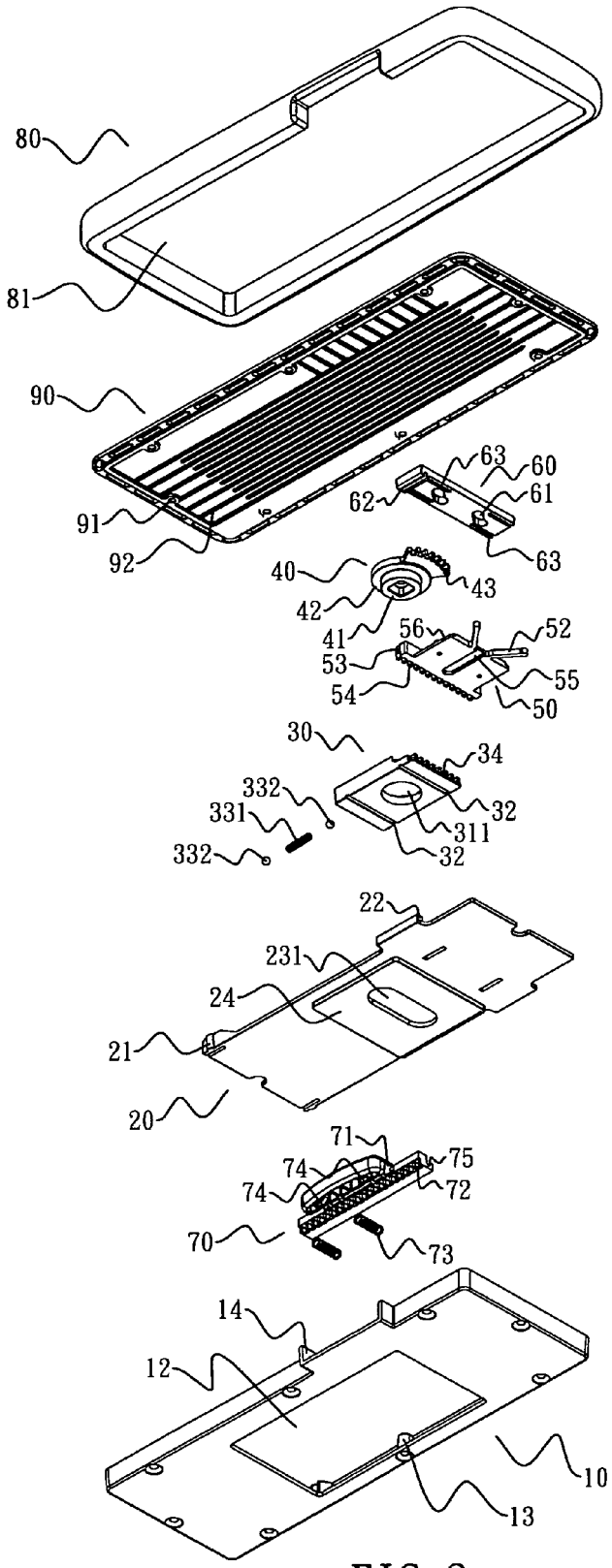
FIG. 3 is a second exploded view of the present invention.
Figure 4:
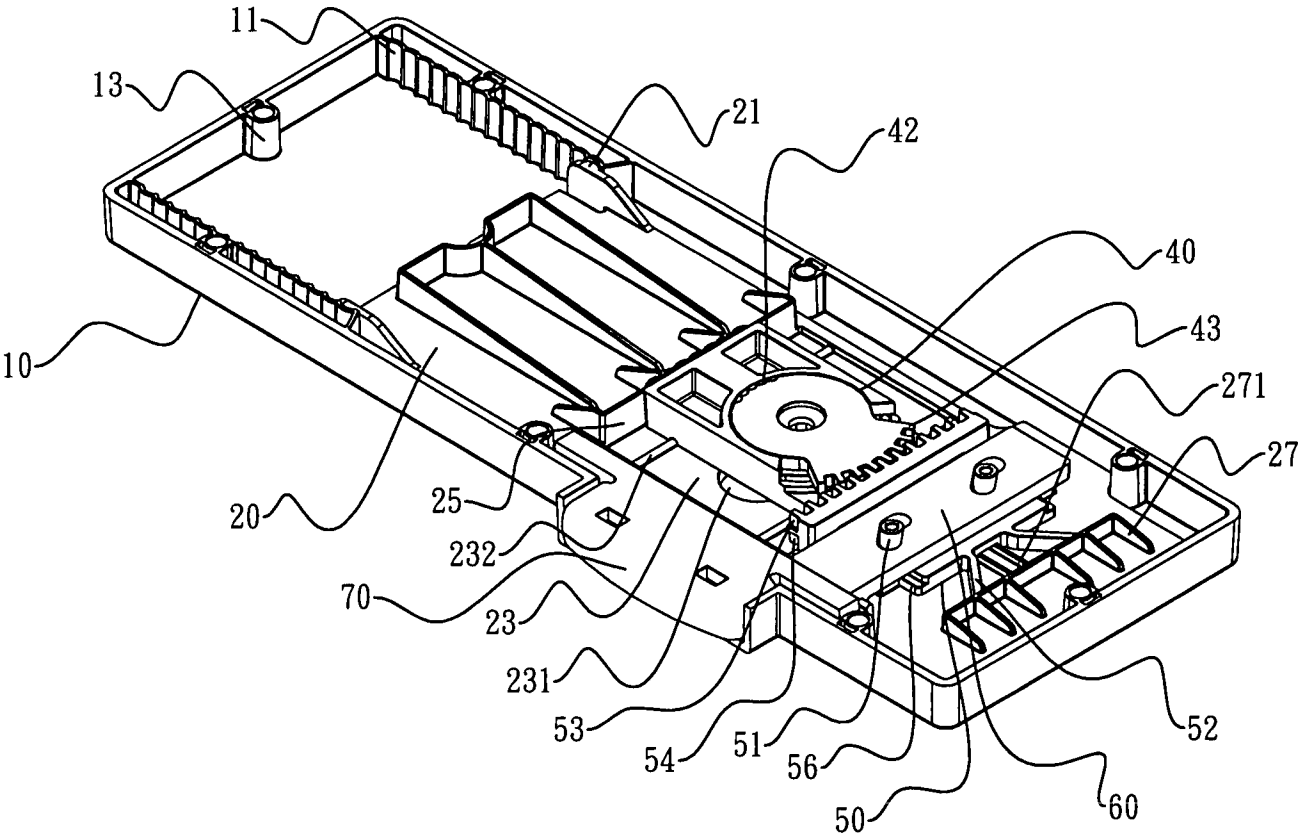
FIG. 4 is a schematic view illustrating the locked position of the present invention.
Figure 5:
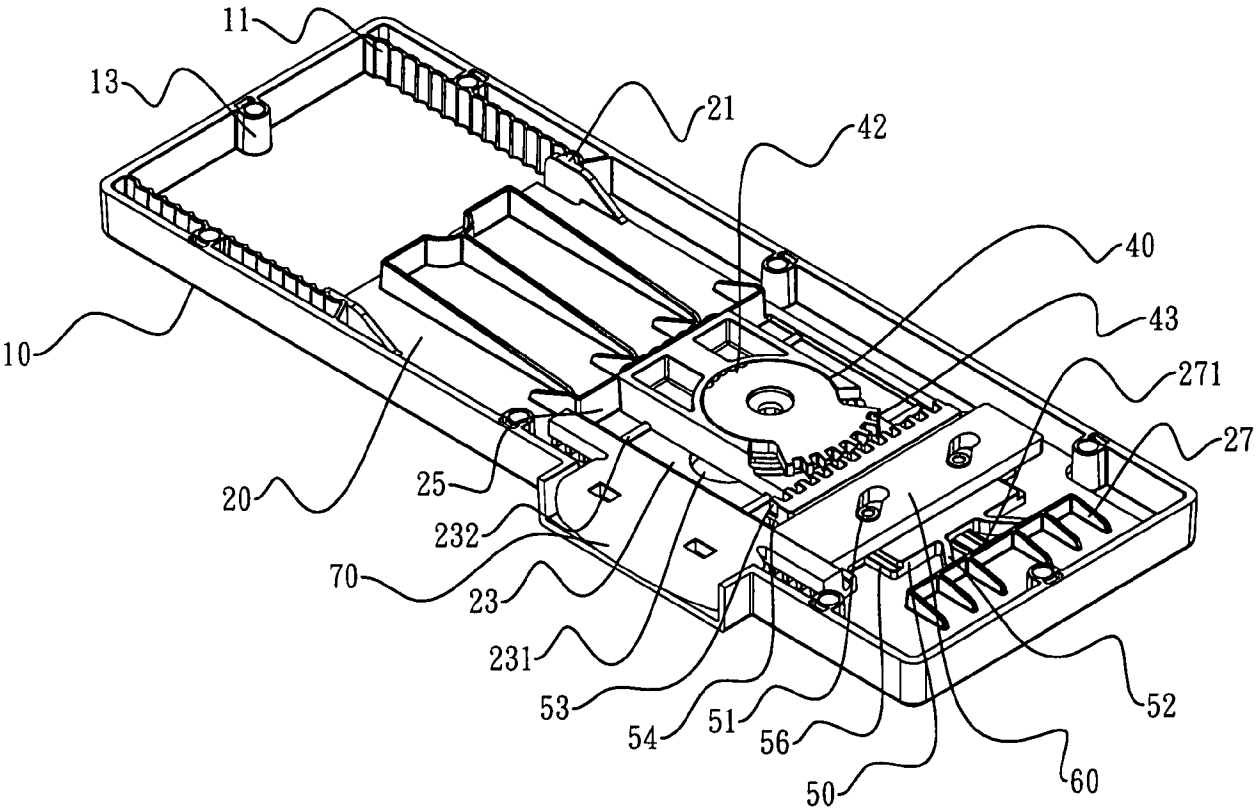
FIG. 5 is a schematic view illustrating the unlocked position of the present invention.

As shown in FIGS. 1 through 8, the multi-functional structure for armchair armrest pad comprises an armrest frame connecting unit (10), a block slider (20), a movable fixing unit (30), a rotary positioning unit (40), a fixing unit (50), an inclined movable unit (60), a pressing unit (70), an armrest pad (80) and a top board (90), wherein a positioning groove (11) is set on one end of the inner wall of the armrest frame connecting unit (10), a window (12) is set in the middle, a few locking units (13) are set around the window (12), and a button mounting slot (14) is set near the window (12), a baffle bar (141) is set in the button mounting slot (14).

The block slider (20) is set in the armrest frame connecting unit (10), a shrapnel (21) is set in the positioning groove (11) which corresponded with the armrest frame connecting unit (10), the teeth (22) are set on the side of the button mounting slot (14) which corresponded with the armrest frame connecting unit (10), a mounting slot (23) is set in the middle of the block slider (20), a raised block (24) is set at the bottom corresponded with the mounting slot (23), a mounting hole (231) is set in the middle of the mounting slot (23), a slide track (232) is set each side of the mounting hole (231), baffle 1 (25) is set on one side of the mounting slot (23) which is near the shrapnel (21), and on the other side set a guiding unit (26) inside and baffle 2 (27) outside, a positioning groove (251) is set on one inner side of the baffle 1 (25), a groove (261) is set on one inner side of the guiding unit (26), a block (262) is set on the top, and a guiding track (271) is set on one inner side of baffle 2 (27).

The movable fixing unit (30) is set in the mounting slot (23) of the block slider (20), a circular groove (31) is set in the middle, a fillister (32) is set at the bottom correspondingly with the slide track (232) of the block slider (20), a hole (311) is set on the circular groove (31), a fitting hole (33) of the movable fixing unit (30) is set on the side out of the circular groove (31), teeth (34) are set on another side, a spring (331) is set in the fitting hole (33), a ball (332) is set on each end of the fitting hole (33).

The rotary positioning unit (40) is set in the circular groove (31) of the movable fixing Unit (30), a cylinder (41) penetrating through the hole (311) of the movable fixing unit (30) is set at the expanded bottom, a positioning groove (42) and wheel teeth (43) are set correspondingly respectively with the fitting hole (33) and the teeth (34) of the movable fixing unit (30).

The fixing unit (50) is set on the block slider (20), wherein two fitting cylinders (51) are set in the middle, a flexible unit (52) is set on one end of the baffle 2 (27), and upper teeth (53) an down teeth (54) are set on the other end, a guiding groove (55) is set correspondingly with the guiding track (271) of the block slider (20), an L-shaped sliding groove (56) corresponded with the guiding unit (26) of the block slider (20) on the fixing unit (50), the upper teeth (53) connects the wheel teeth (43) of the rotary positioning unit (40) and the down teeth (54) connects the teeth (34) of the movable fixing unit (30).

The inclined movable unit (60) is set on the fixing unit (50), whereon an inclined hole (61) is set on the fitting cylinder (51) corresponded with the fixing unit (50), a connecting part (62) corresponded with the button mounting slot (14) of the armrest frame connecting unit (10) is set at the bottom, a guiding groove (63) corresponded with the guiding unit (26) of the block slider (20) at the bottom is set on the inclined movable unit (60).

The pressing unit (70) is set in the button mounting slot (14) of the armrest frame connecting unit (10), a fillister (71) is set at the bottom corresponding with the baffle bar (141) of the button mounting slot (14), on the two sides of the fillister (71), fitting teeth (72) are set on one side of the teeth (22) which corresponded with the block slider (20), a spring fitting hole (74) is set on the other side, a connecting part(75) corresponded with the connecting part (62) of the inclined movable unit (60) is set on the pressing unit (70).

The armrest pad (80) is covered on the armrest frame connecting unit (10), a fitting Groove (81) is set around the armrest frame connecting unit (10), a top board (90) is set in the fitting groove (81).

A fixing hole (91) is set on the top board (90) corresponded with the locking unit (13) of the armrest frame connecting unit (10) at the bottom, a few packing strips (92) which can pack all units of the armrest frame connecting unit (10) and reduce the friction each unit with the top board (90) are set at the bottom of the top board (90).

Figure 6:
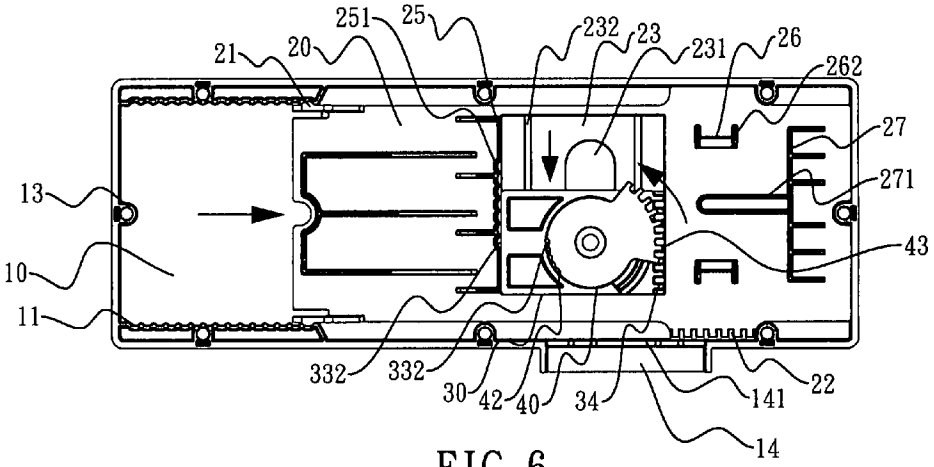
FIG.6 is a first schematic view illustrating the movement of the block slider, movable fixing unit and rotary positioning unit of the present invention.
Figure 7:
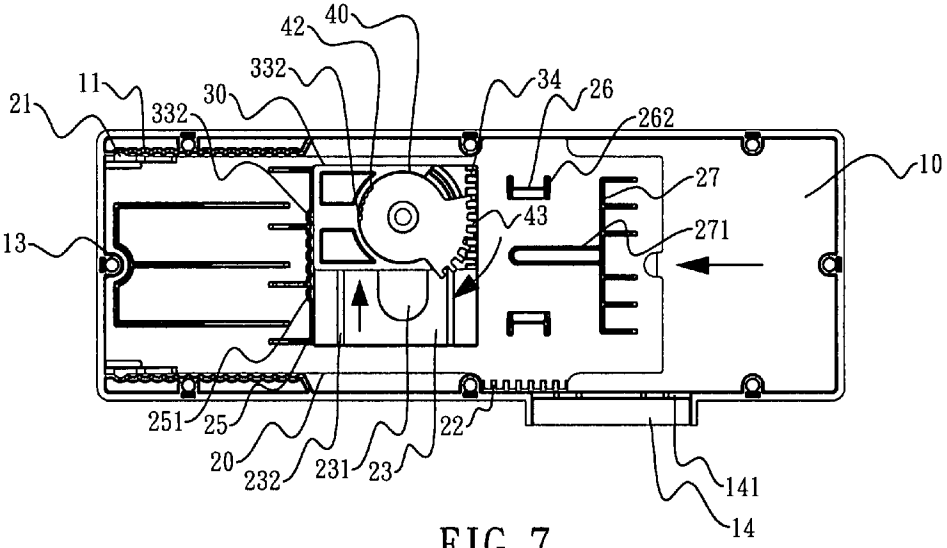
FIG. 7 is a second schematic view illustrating the movement of the block slider, movable fixing unit and rotary positioning unit of the present invention.
Figure 8:
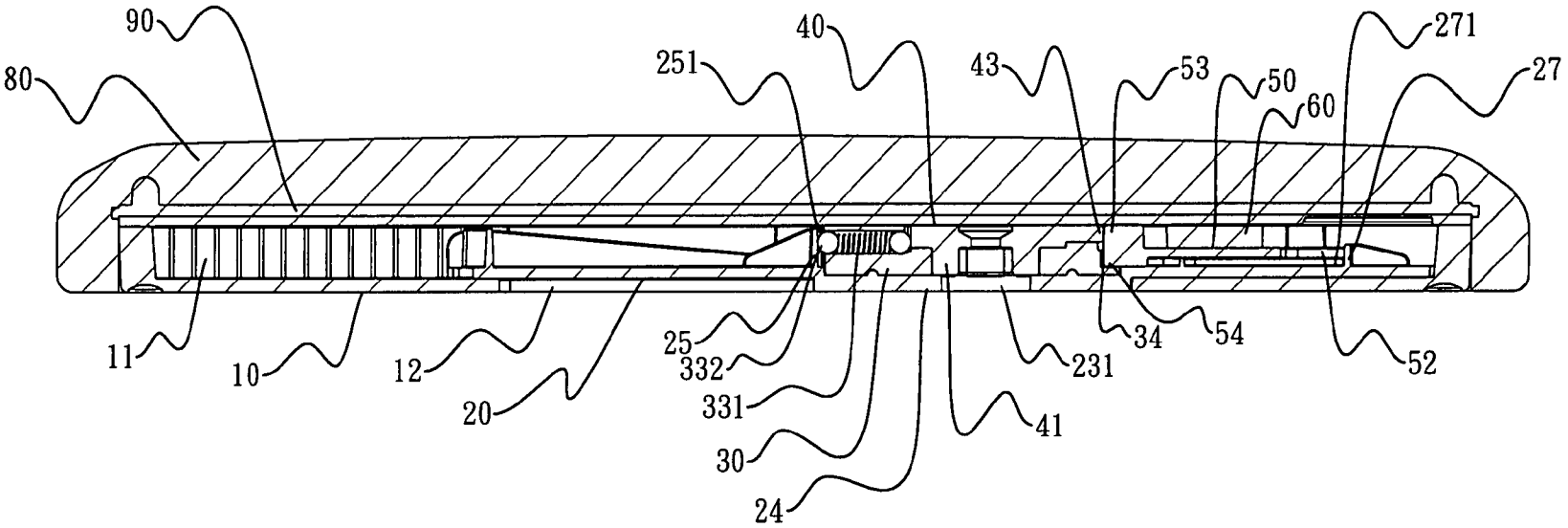
FIG. 8 is a perspective view of the present invention.

As shown in FIGS. 4 through 7, when pressing inwardly the pressing unit (70), the pressing unit (70) departs, the fitting teeth (72) on top and the teeth (22) of the block slider (20) fits together, thus enable the block slider (20) move forward and backward in the armrest frame connecting unit (10). As shown in FIGS. 6 and 7, the armrest pad (80) can be adjusted forward and backward, but the moving range is the same as the moving range of the raised block (24) in the window (12). When moving the block slider (20), the shrapnel (21) and the positioning groove (11) on the armrest frame connecting unit (10) match tightly, so that it forms a multi-stage moving structure and make the armrest pad (80) not too loose when moving forward and backward. Meanwhile, the inclined movable unit (60) is pushed by the pressing unit (70), the inclined hole (61) forces the fitting cylinder (51) of the fixing unit (50) and makes the fixing unit (50) move along the guiding track (271) of the block slider (20), thus makes the upper teeth (53) and the down teeth (54) depart from the teeth (34) of the rotary positioning unit (40) and the wheel teeth (43), and enables the rotary positioning unit (40) rotate in the circular groove (31) of the movable fixing unit (30). Therefore, the armrest pad (80) can be rotated to the left and the right, and the movable fixing unit (30) can move along the slide track (232) in the mounting slot (23) of the block slider (20), so that the armrest pad (80) can be adjusted to the left and right. When rotate the rotary positioning unit (40), the positioning groove (42) thereon and the ball (332) on one end of the movable fixing unit (30) can fit together to form a multi-stage structure and make the armrest pad (80) not too loose when being adjusted to the left or right. When moving the movable fixing unit (30), the ball (332) on the other end and the positioning groove (251) of the block slider (20) may fit together to form a multi-stage structure and make the armrest pad (80) not too loose when being adjusted to the left or right. This is so called the unlocked position.

After adjusting the structure, let go the pressing unit (70), and the spring (73) in the spring fitting hole (74) of the pressing unit(70) and the baffle bar (141) of the armrest frame connecting unit(10) may bring the reacting force and make the pressing unit (70) back to its original position, the fitting teeth (72) thereon and the teeth (22) of the block slider (20) fit together to secure the block slider (20). The inclined movable unit (60) is pulled back by the pressing unit (70) and then return back to its original position. Meanwhile, the flexible unit (52) of the fixing unit (50) and the baffle 2 (27) of the block slider (20) produce the reacting force and make the fixing unit (50) back to its position. The upper teeth (53), the down teeth (54) again fit together with the wheel teeth (43) of the rotary positioning unit (40) and the teeth (34) of the movable fixing unit (30) to secure the rotary positioning unit (40) and the movable fixing unit (30). This is so called locked position.

The invention has the following advantages: Firstly, the unlocked position can easily get when pressing the pressing unit (70), thus the armrest pad (80) can be adjusted to the front, back, left, right, and be rotated to the right and the left. Secondly, the locked position can easily get when letting go the pressing unit (70), thus the armrest pad (80) can be fixed and remained the angle which is adjusted.

Thirdly, the adjustment is not only for one angle, but also can be made to the front or back, left or right and rotate to the left or right at the same time.

Although specific embodiments have been illustrated and described, it will be obvious to those skilled in the art that various modifications may be made without departing from what is intended to be limited solely by the appended claims.

What is claimed is:

1. A multi-functional structure for armchair armrest pad comprises:

an armrest frame connecting unit, a block slider, a movable fixing unit, a rotary positioning unit, a fixing unit, an inclined movable unit, a pressing unit, an armrest pad and a top board, wherein a positioning groove is set on one end of the inner wall of said armrest frame connecting unit, a window is set in the middle, a plurality of locking units are set around said window, and a button mounting slot is set near said window, a baffle bar is set in said button mounting slot;

said block slider is set in said armrest frame connecting unit, a pawl is set in said positioning groove which corresponds with said armrest frame connecting unit, teeth are set on the side of said button mounting slot which corresponds with said armrest frame connecting unit, a mounting slot is set in the middle of said block slider, a raised block is set at the bottom corresponds with said mounting slot, a mounting hole is set in the middle of said mounting slot, a slide track is set each side of said mounting hole, a first baffle is set on one side of said mounting slot which is near said pawl, and a guiding unit and a second baffle is set on the other side of said mounting slot, a positioning groove is set on one inner side of said first baffle, a groove is set on one inner side of said guiding unit, a block is set on the top, and a guiding track is set on one inner side of said second baffle;

said movable fixing unit is set in said mounting slot of said block slider, a circular groove is set in the middle, a first linear guide groove is set in the bottom correspondingly with said slide track of said block slider, a hole is set on said circular groove, a fitting hole of said movable fixing unit is set on the side out of said circular groove, teeth are set on another side;

said rotary positioning unit is set in said circular groove of said movable fixing unit, a cylinder penetrating through said hole of said movable fixing unit is set at the expanded bottom, a positioning groove and wheel teeth are set correspondingly respectively with said fitting hole and said teeth of said movable fixing unit;

said fixing unit is set on said block slider, wherein two fitting cylinders are set in the middle, a flexible unit is set on one end of said second baffle, and a set of upper teeth and lower teeth are set on the other end, an L-shaped sliding groove corresponds with said guiding unit of said block slider on said fixing unit, said upper teeth connects said wheel teeth of said rotary positioning unit and said lower teeth connects said teeth of said movable fixing unit;

said inclined movable unit is set on said fixing unit, whereon an inclined hole is set on said fitting cylinder corresponds with said fixing unit, a connecting part corresponds with said button mounting slot of said armrest frame connecting unit is set at the bottom, a guiding groove corresponds with said guiding unit of said block slider at the bottom is set on said inclined movable unit;

said pressing unit is set in said button mounting slot of said armrest frame connecting unit, a second linear guide groove is set in the bottom of said pressing unit corresponding with said baffle bar of said button mounting slot, on the two sides of said second linear guide groove, fitting teeth are set on one side of said teeth which corresponds with said block slider, a spring fitting hole is set on the other side;

said armrest pad is covered on said armrest frame connecting unit, a fitting groove is set around said armrest frame connecting unit, said top board is set in said fitting groove;

a fixing hole is set on said top board corresponds with said locking unit of said armrest frame connecting unit at the bottom, a plurality of packing strips are set at the bottom of said top board;

when said pressing unit is displaced inward, said fitting teeth disengages said teeth of said block slider permitting adjustment of said armchair armrest pad in a first linear direction., said inclined movable unit is displaced in the direction of said pressing unit and displaces said fixing unit, said upper teeth of said fixing unit disengages said wheel teeth permitting adjustment of said armchair armrest pad in a rotational direction; and said lower teeth of said fixing unit disengages said teeth of said movable fixing unit permitting adjustment of said armchair armrest pad in a second linear direction perpendicular to said first linear direction.

2. A multi-functional structure for armchair armrest pad as recited in claim 1, wherein a spring is set in said fitting hole of said movable fixing unit, and a ball is set on each end of said fitting hole.

3. A multi-functional structure for armchair armrest pad as recited in claim 1, wherein a guiding groove on said fixing unit is set corresponds with said guiding track of said second baffle.

4. A multi-functional structure for armchair armrest pad as recited in claim 1, wherein a connecting part on said pressing unit is set corresponds with said connecting part of said inclined movable unit.

* * * * *